US005452821A

United States Patent [19]

Heath et al.

[11] Patent Number: 5,452,821

[45] Date of Patent: Sep. 26, 1995

[54] VENDING MACHINE DISPENSING APPARATUS

[76] Inventors: Kevin Heath, 395 Clary Ave.; Bruce Stanger, 3523 Iona Rd., both of Idaho Falls, Id. 83401

[21] Appl. No.: 247,008

[22] Filed: May 20, 1994

[51] Int. Cl.[6] ..... G07F 11/06

[52] U.S. Cl. ..... 221/90; 221/133; 221/273; 221/274

[58] Field of Search ..... 221/90, 133, 272, 221/273, 274, 276

[56] References Cited

U.S. PATENT DOCUMENTS

| | | | |
|---|---|---|---|
| 2,533,623 | 12/1950 | Ransom | 221/90 X |
| 2,936,931 | 5/1960 | Forst et al. | 221/90 |
| 2,996,217 | 8/1961 | Gabrielsen et al. | 221/90 |
| 3,031,101 | 4/1962 | Dasher | 221/90 |
| 3,160,314 | 12/1964 | Bendl | 221/90 |
| 3,685,689 | 8/1972 | Borner et al. | 221/90 |

*Primary Examiner*—William E. Terrell
*Assistant Examiner*—Dan A. Reichard
*Attorney, Agent, or Firm*—Thrope, North & Western

[57] ABSTRACT

A vending machine with a frame in which there are numerous pivoting shelves, each shelf having a tang which extends through a hole in the frame, each tang having a tab positioned to frictionally interact with a side of the hole to keep the shelf in a generally horizontal position until the tab is forced out of the frictional interaction by a ratchet slide which travels vertically up a ratchet column disposed next to the frame. The ratchet column causes the slide to ratchet upward by moving a face of the column up and down vertically, causing grooves on the column to lift the slide. Each movement of the face up and back down causes the slide to ratchet to a position one hole higher, forcing the tang out of frictional interaction with the hole wall which causes the shelf to pivot and drop its contents into an accessible receptacle at the bottom of the machine.

17 Claims, 6 Drawing Sheets

VENDING MACHINE DISPENSING APPARATUS

BACKGROUND OF THE INVENTION

The present invention relates to an improved coin operated vending apparatus and, in particular, to an improved dispensing mechanism within a coin operated vending machine.

Coin operated vending machines allow a "customer" to purchase various products at locations where it is impractical to have a sales person readily available. The use of vending machines has become common, and such machines have served as a convenient means of selling merchandise since at least the early 1900s. See, e.g., U.S. Pat. No. Des. 53,876.

Products currently sold through vending machines range from postage stamps to larger consumable goods such as candy and food. The advent of credit card operated vending machines greatly increase the number of products which can be sold in this manner. The items which potentially can be sold through vending machines are limited only by the size of the item and the size of the machine.

The early vending machines were simple mechanical devices. However, there has been a trend toward highly automated, electronic vending machines that are both expensive to make and maintain. When in use, these machines consume significant amounts of electricity. When they malfunction, the electronic machines are often difficult and expensive to repair. Thus, a dependable coin operated vending machine that is simple and does not require electricity is desirable.

SUMMARY OF THE INVENTION

It is an object of the invention to provide a dependable vending machine which is inexpensive to build and to operate.

It is a further object of the invention to provide a vending machine which requires low maintenance and little or no electricity.

The above and other objects of the invention are realized in an embodiment of the invention which includes a vending apparatus having a frame with numerous shelves arranged in vertical rows. The shelves are spaced far enough apart to hold stamps, candy or some other merchandise.

Each shelf is attached within the frame so that it can pivot between a horizontal position and a generally vertical position. When the shelf is in a horizontal position, the merchandise rests on the shelf. When the shelf pivots to a vertical position, any merchandise on the shelf falls into a receptacle below the frame, where it may be retrieved by a person using the machine.

In order to hold the shelves in the horizontal position, each shelf has a small extension or tang. The tang extends beyond the pivot point so that as the shelf pivots downwardly, the tang pivots upwardly. Holding the tang in a horizontal position prevents the corresponding shelf from pivoting downwardly.

The frame member has rows of openings which align with each row of shelves such that the tang of each shelf extends through a corresponding opening when the shelf is in the horizontal position. Each opening has an upper portion and a lower portion. The tang has a small tab which extends adjacent to the lower portion of the opening. The tab is in frictional contact with a portion of the frame member adjacent to the lower portion, thus maintaining the tang and shelf in a horizontal position.

To allow the tang and shelf to rotate and drop the merchandise into the receptacle, the tang is pried out of contact with the lower section. This is accomplished by a small slide that ratchets upwardly along the row of openings. The slide is moved upwardly by a grooved rachet column which is attached to the frame and positioned adjacent to the row of openings. With each incremental advancement, the slide contacts one tang, forcing the tang out of the lower portion and causing the shelf to fall into its vertically inclined position. Any merchandise on the shelf is dropped into the receptacle.

BRIEF DESCRIPTION OF THE DRAWINGS

The above and other objects, features and advantages of the invention will become apparent from a consideration of the following detailed description presented in connection with the accompanying drawings in which:

FIG. 3*a* is a fragmented view of an alternate structure to the shelf shown in FIG. 3.

DETAILED DESCRIPTION

Figure 1:
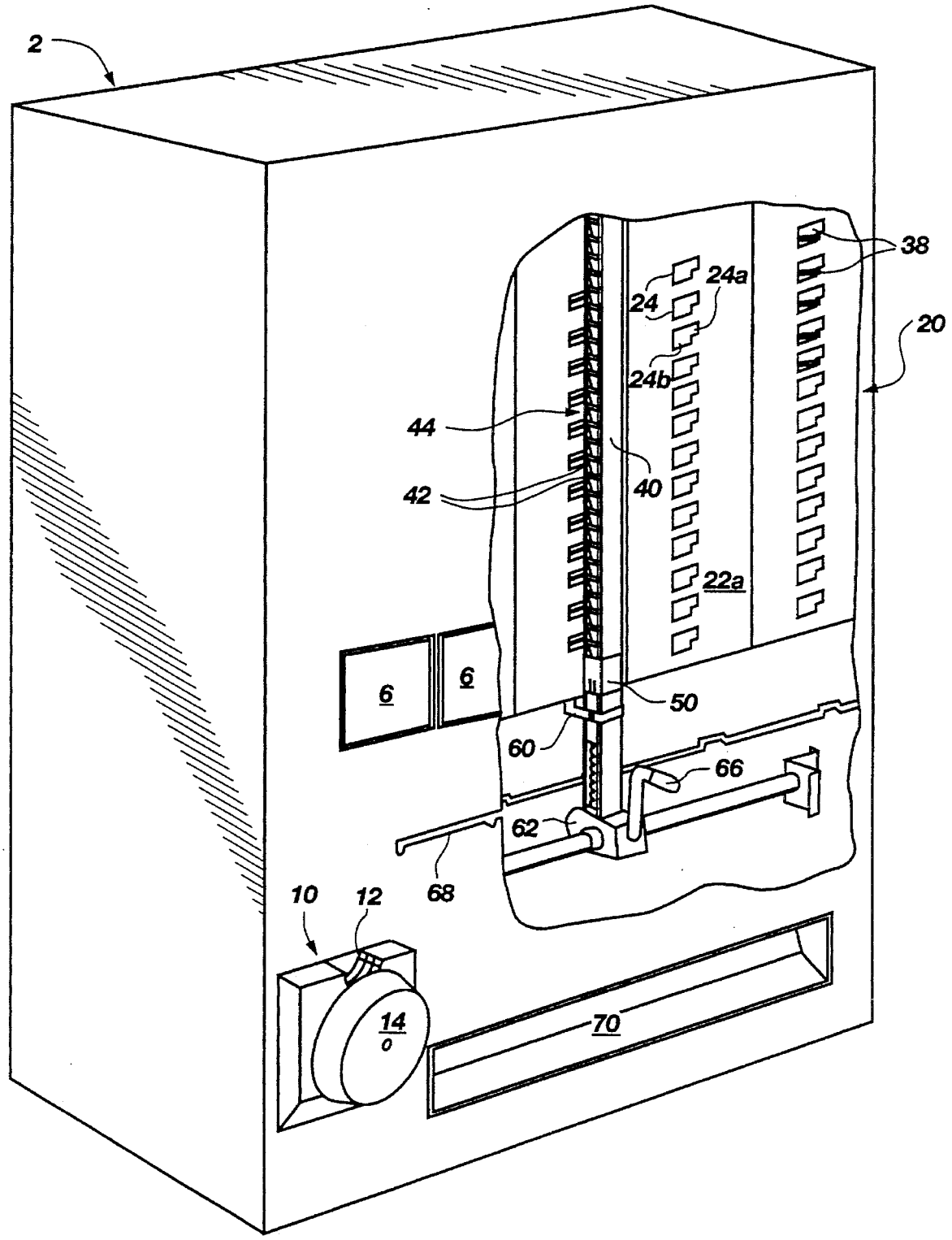
FIG. 1 is a perspective, cut away view of a vending machine made in accordance with the present invention.
Figure 2:
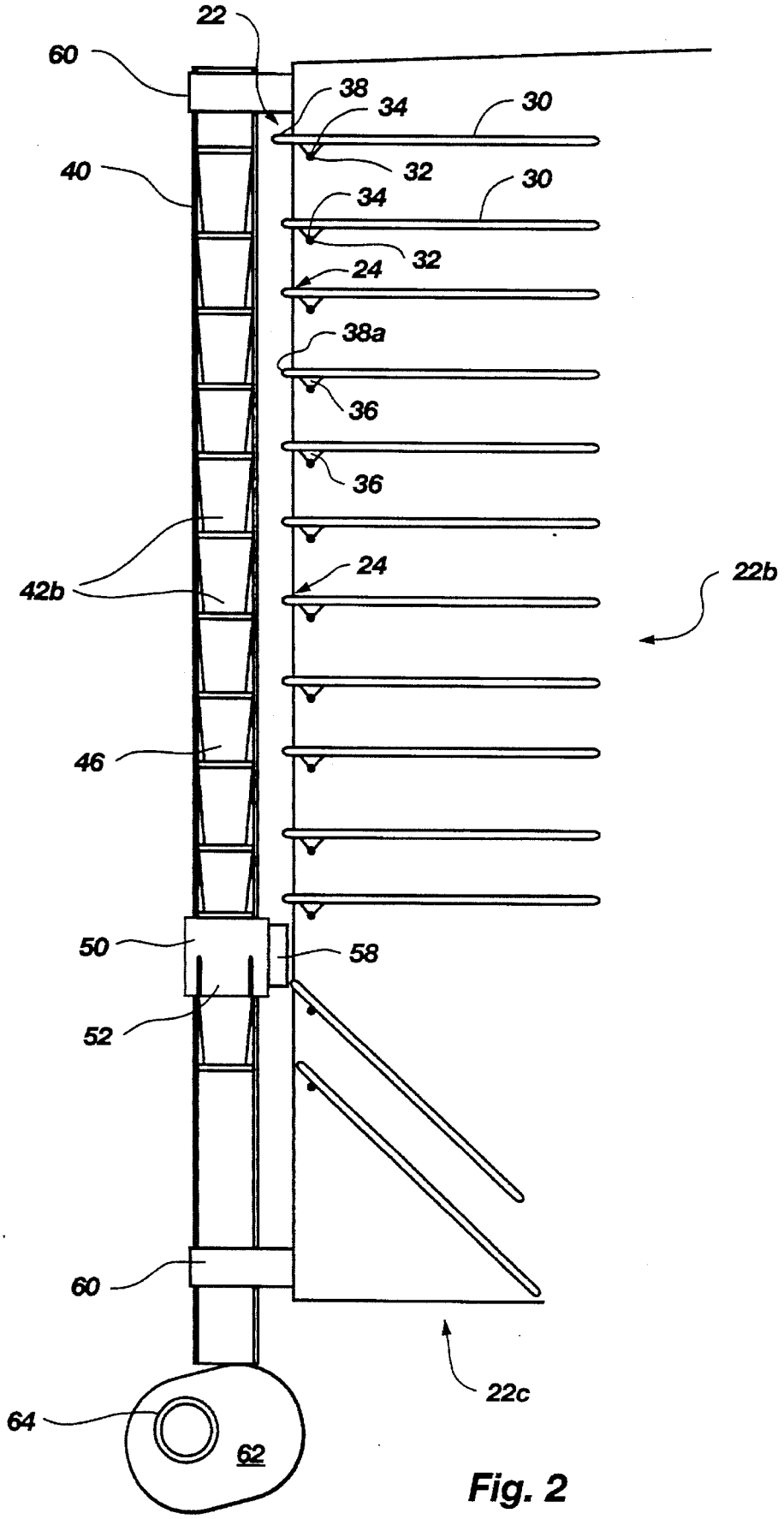
FIG. 2 is a side cross-sectional view of the frame member and ratchet column of the instant invention showing the second face of the ratchet column and the shelves within the frame member, some of the shelves being in an unreleased, generally horizontal position and others being in a released, generally vertical position.

Referring to FIGS. 1 and 2, there is shown an illustrative embodiment of a vending machine dispensing apparatus 2 made in accordance with the present invention. The apparatus 2 has a chassis or housing 4 with multiple display windows 6, and a coin latch mechanism 10 which is operated by placing coins in the coin slots 12 and rotating the knob 14. Coin latch mechanisms are well known in the art and any person skilled in the vending machine art will be able to readily adapt different types of coin latch mechanisms to the instant invention.

A cut away section of the chassis or housing 4 reveals a frame member 20. In the present embodiment the frame member 20 is made of steel or plastic and comprises four outside panels positioned so as to form the front 22*a*, top, and lateral sides (not shown) of a rectangular box. As shown best in FIG. 2, the frame member 20 is open on a back side 22*b* to allow placement of merchandise within the frame member 20. The frame member 20 is also open on a bottom side 22*c* to allow merchandise within the frame member 20 to fall into a receptacle below the frame member 20.

Again referring to FIG. 1, the front side 22*a* of the frame member 20 has a plurality of openings 24 which are arranged in vertical rows. Each opening 24 has a larger, upper portion 24*a* and a smaller, lower portion 24*b*. In a preferred embodiment, the upper portion 24*a* is approximately twice the width of the lower portion 24*b*.

Figure 3:
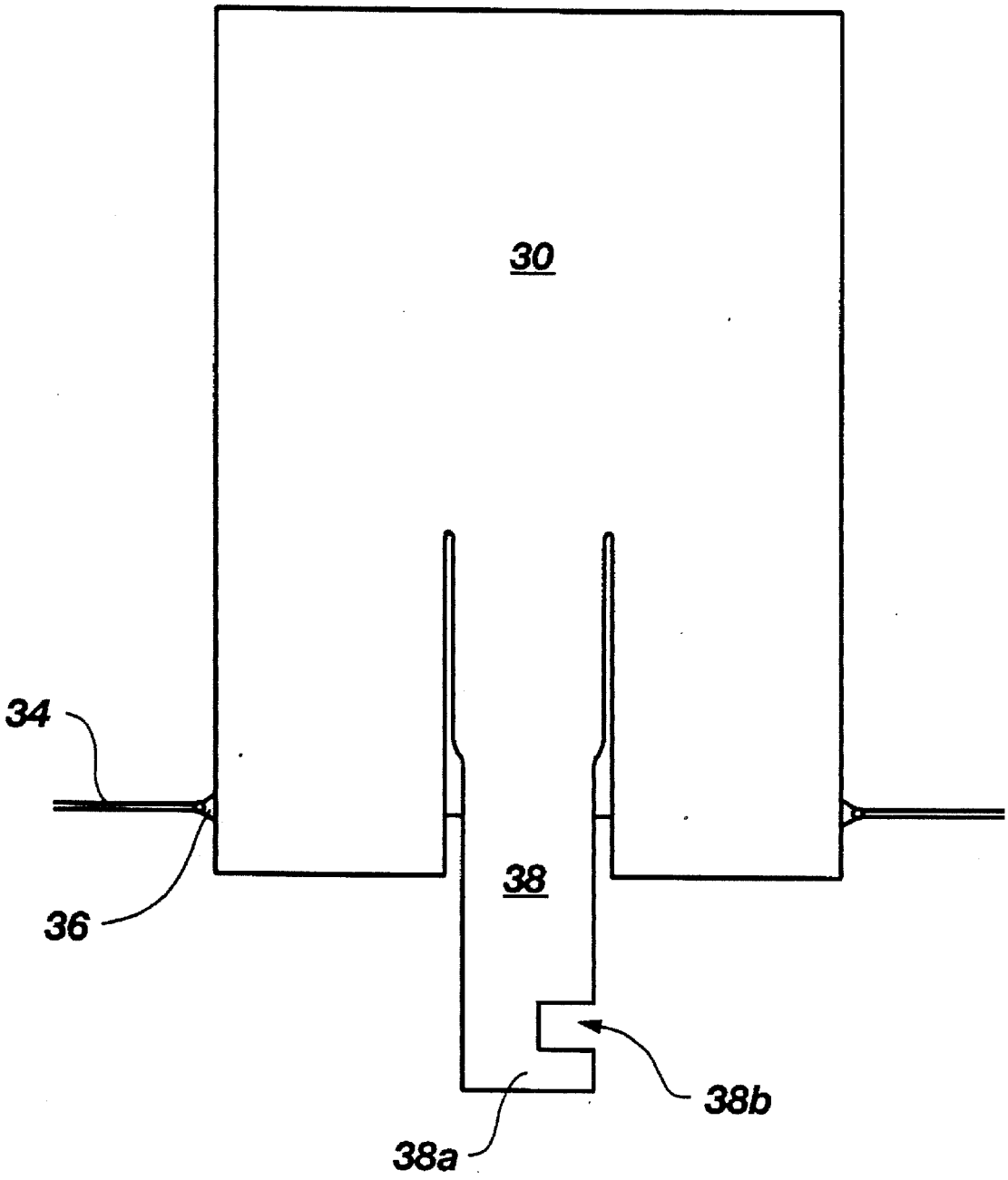
FIG. 3 is a top, plan view of a tang and shelf.

Disposed within the frame member 20 is one or more rows of pivoting shelves 30, as shown in FIGS. 2 and 3. The shelves 30 are arranged in vertical rows so that each shelf 30 corresponds with an opening 24. Each shelf 30 is pivotally attached to the frame member 20 at a pivot point 32 such that the shelf 30 can pivot downwardly from a horizontal position to a position inclined toward the vertical. Pivoting the shelf 30 downward causes any items positioned on the shelf 30 to fall through the open space at the bottom of the frame member 20.

Each vertical row of shelves 30 is separated from the adjacent rows by a metal or plastic wall (not shown). Each shelf pivots about a wire 34 which passes horizontally under the shelf, near the opening 24. For ease of construction, the wire 34 can extend from one lateral side of the frame to the other, passing beneath several shelves 30 having the same horizontal position. Each shelf 30 is attached to the wire 34 by a small arm 36 which extends downwardly from the shelf 30. The arm 36 is positioned such that most of the shelf 30 extends perpendicularly from the wire 34 on a side opposite the opening 24. Because most of the shelf 30 is disposed on one side of the wire 34, the weight of the shelf 30 causes it to pivot downwardly unless the shelf 30 is held in place.

In the alternative to the wire 34, a small pivot pin 34*a* (shown in FIG. 3*a*) can extend from the arm 36 and nest in a pivot hole in the wall (not shown) adjacent to the shelf 30. The advantage of using the pivot pin is that a single shelf 30 can be removed from the frame member 20 without disturbing the other shelves in the same horizontal row. If the arm 36 and pivot pin 34*a* are made of a resilient material, the shelves 30 can easily be inserted and removed by deforming the arm 36 and pin 34*a*.

In order to hold the shelf 30 in a horizontal position, a small extension or tang 38 extends from the shelf 30 to a side of the wire 34 or pivot arm 34*a* opposite the shelf 30 (as shown in FIG. 3). The tang 38 has a notch 38*a* near the end opposite the shelf 30, leaving a small tab 38*b*, and is long enough to extend through the opening 24 when in a horizontal position. When the tang 38 is rotated into the smaller, lower portion 24*b*, the tab 38*b* comes into frictional contact with the side of the lower portion 24*b*, latching the tang 38 into the lower portion.

When the tang 38 is latched in the lower portion 24*b* (FIG. 1), the tang 38 and the attached shelf 30 are held in a generally horizontal position (as shown in FIG. 2). When pressure is applied to the tang 38 or tab 38*b* to overcome the frictional engagement between the tab 38*b* and the side of the lower portion 24*b*, the tang 38 is lifted from the lower portion 24*b*; the weight of the shelf 30 causing the shelf 30 to pivot downwardly. Any merchandise sitting on the shelf 30 slides off and drops through the bottom 22*c* (FIG. 2) of the frame. The tang 38, being much lighter, is carried upwardly as the shelf 30 rotates. The size of the shelf 30 depends on the product which is to be dispensed from the apparatus. The exact size of the tang 38 and tab 38*b* are, of course, dependant on the size of the shelf 30 and the anticipated weight of the product to be placed on the shelf.

Referring now to FIG. 2, the tang 38 and tab 38*b* must be lifted from the corresponding lower portion 24*b* to allow the shelf 30 to pivot downwardly. For this purpose, a ratchet column 40 is attached to the frame and positioned next to the openings 24 and the first end 38*a* of each tang 38. The ratchet column 40 has a small slide 50 which advances up the column in incremental movements. With each advance, the slide 50 contacts the bottom side of a tang 38 or tab 38*b* with sufficient force to overcome the frictional force by which the tab 38*b* is held adjacent the lower portion 24*b*. Thus, with each advancement of the slide 50, one shelf 30 pivots from a horizontal position to a semi-vertical position, dispensing its contents. In practical use, the slide 50 is advanced one shelf 30 each time a person using the machine chooses the product in that vertical row. When the slide 50 reaches the top of the column, each tab 38*b* must be reset adjacent to the corresponding lower portion 24*b*, and merchandise must be placed on the once-again horizontal shelves 30.

The slide 50 can be advanced up the grooved column 40 in several different ways. First, the grooved column 40 can be cylindrical and threaded like a bolt. The slide 50 can have mating threads, such that when the grooved column 40 is rotated, the slide 50 moves upward along the column in the same manner as a nut is unthreaded from a bolt. In a preferred embodiment, however, the ratchet column 40 has a rectangular bottom and top, with long rectangular sides. The grooves 42 are disposed horizontally on two sides or faces 44, 46 of the column. An exploded view of the ratchet column 40 is shown in FIG. 4.

Figure 4:
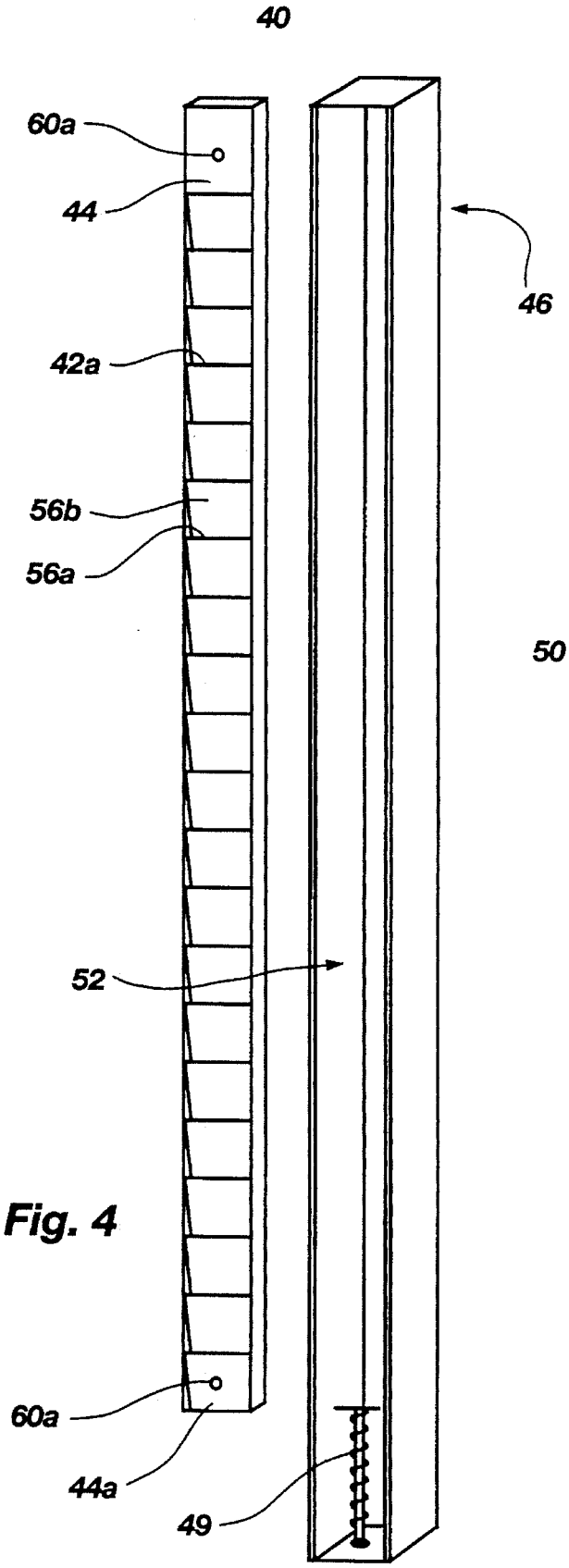
FIG. 4 is an exploded view of the ratchet column in which the first face has been removed from the column.
Figure 6A:
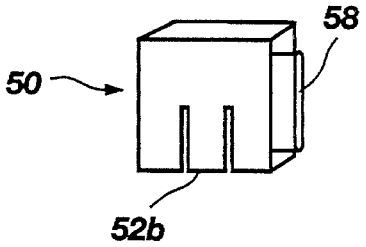
FIG. 6*a* is a side view of the ratchet slide.
Figure 6B:
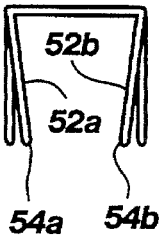
FIG. 6*b* is a side cross-sectional view of the ratchet slide taken along the axis.
Figure 6C:
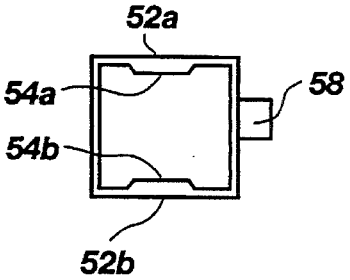
FIG. 6*c* is a top, plan view of the ratchet slide.

Referring now to FIGS. 1, 2 and 4, the ratchet column 40 of the preferred embodiment has a grooved first face 44 (shown in FIGS. 1 and 4) disposed on the opposite side of the ratchet column 40 from a grooved second face 46 (shown in FIG. 2). The first face 44 is fixedly attached to the frame member 20 by one or more arms 60 extending from the frame member 20. The arms 60 hold the first face 44 in a generally vertical position. In a preferred embodiment, screws are placed through the arms 60 and into two setting holes 60*a* (shown in FIG. 2) in the first face 44. The arms 60 also wrap around the second face 46, holding the second face 46 adjacent the first face 44, but allowing the second face 46 to move vertically.

Figure 5A:
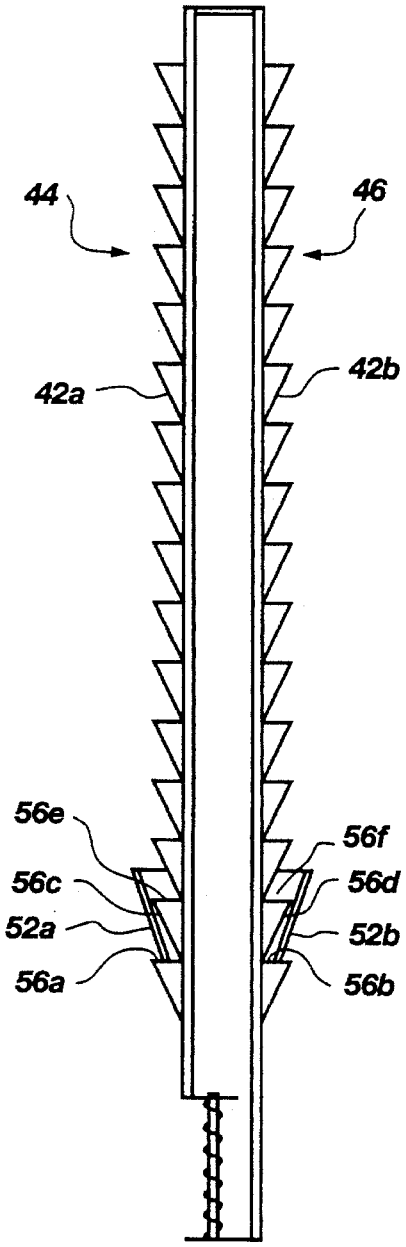
FIG. 5*a* is a side cross-sectional view of the ratchet column and ratchet slide with the second face in the first position.
Figure 5B:
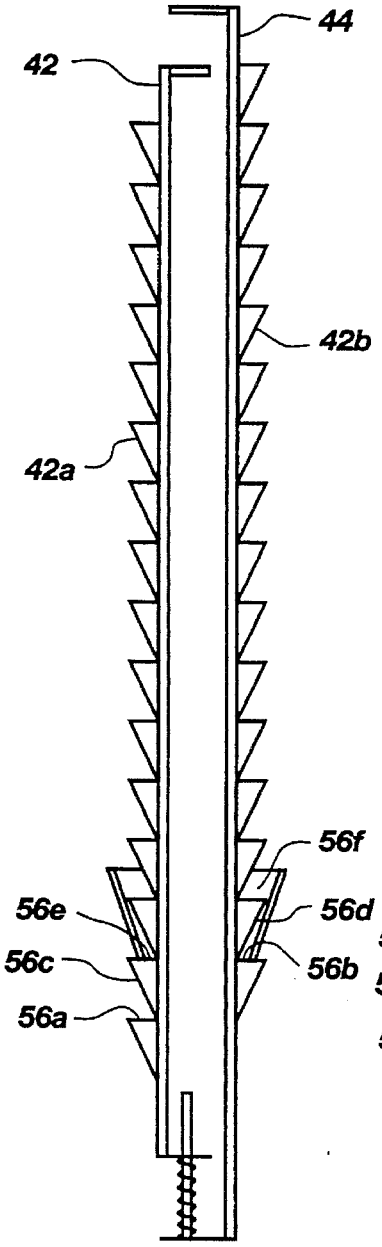
FIG. 5*b* is a side, cross-sectional view in which the second face has been moved into the second position.
Figure 5C:
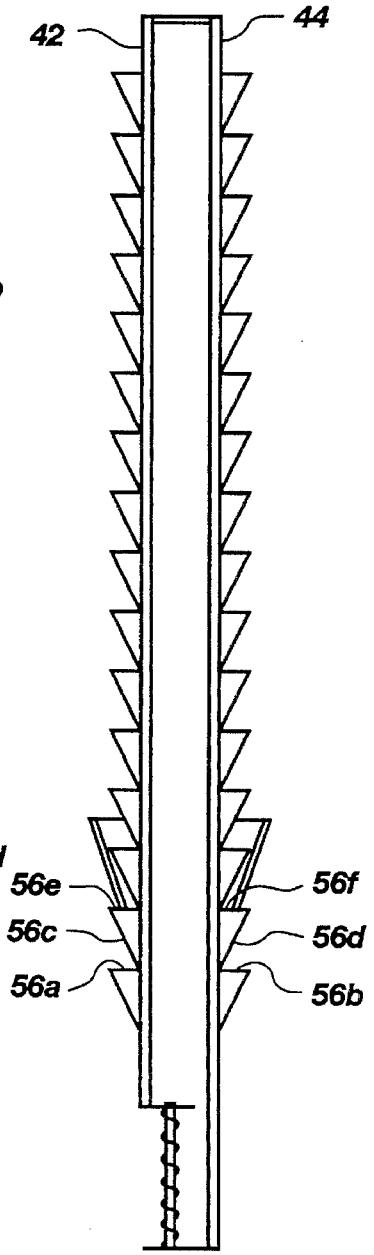
FIG. 5*c* is a side, cross-sectional view of the ratchet column and ratchet slide in which the second face has returned to the first position, leaving the ratchet slide one groove higher than in FIG. 5*a;*

In the preferred embodiment, the second face 46 has walls 46*a*, 46*b*, 46*c*, 46*d* which extend backwardly to form a channel 48 behind the second face 46 (shown in FIG. 4). The first face 44 is held in the channel 48 by the arms 60. A spring 49 (shown in FIGS. 1 and 4) is disposed in the channel 48 so as to press downwardly against a bottom wall 46*d* of the second face 46 and upwardly against the bottom 44*a* of the first face 44 when the first face 44 is held within the channel 48. As is shown in FIGS. 5*a*–*c*, the second face 46 slides between a first position (FIG. 5*a*) and a second position (FIG. 5*b*). In the first position (FIG. 5*a*), the grooves 42*b* on the second face 46 are in the same horizontal position as the grooves 42*a* on the first face 44. In the second position (FIG. 5*b*), the grooves 42*b* are slid one groove higher than grooves 42*a*. Once the force pushing the second face 46 into the second position is no longer present, the spring 49 forces the second face 46 to return to its original position (shown in FIG. 5*c*).

The second face 46 is moved between the first position and the second position by rotation of a cam 62 disposed below the ratchet column 40 (shown in FIGS. 1 and 2). Each rotation of the cam 62 causes the slide 50 to advance one groove up the ratchet column 40, releasing one tang 38.

Referring now to FIGS. 5*a–c* and 6*a–c*, the ratchet slide 50 ratchets up the column 40 as the second face 46 moves up and down. The slide 50 is made of a resilient material, and has two flanges 52*a*, 52*b* (shown in FIGS. 6*a–c*) which slant inward to align with the grooves 42 on the first and second faces 44, 46 of the ratchet column 40. At the bottom of each flange 52*a*, 52*b* is a ridge 54*a*, 54*b*. Ridge 54*a* is designed to rest on the lower slope 56*a* of the grooves 42*a* on the first face 44. Ridge 54*b* is designed to rest upon the lower slope 56*b* of the grooves 42*b*. As the second face 46 moves between the first and second positions, the slide 50 is forced upward as ridge 54*b* is lifted by the lower slope 56*b* of groove 42*b*. As the slide 50 moves upward, the ridge 54*a* slides over the upper slope 56*c* on the first face 44, and comes to rest on the lower slope 56*e* of the next higher groove on the first face 44. With the slide 50 positioned one groove higher on the first face 44, the second face 46 returns to its original position (shown in FIG. 5*c*). As the second face 46 moves downwardly, the ridge 54*a* catches on the lower slope 56*e*, preventing the slide 50 from moving downwardly with the second face 46. Instead, ridge 54*b* passes over upper slope 56*d* and comes to rest against lower slope 56*f* of the next higher groove. Each up and down movement of the second face 44 causes the slide 50 to ratchet one groove up the column 40.

In order to pry the tangs 38 from the lower portions 24*b*, the slide 50 has a projection 58 (shown in FIGS. 2 and 6*a*) which extends toward the openings 24. The projection 58 is positioned so as to forcefully contact the bottom of each tang 38 with enough force to move the tang 38 out of the lower portion 24*b*. Because the grooves 42 are spaced apart the same distance as the openings 24, the projection 58 contacts one tang 38 with each advancement of the slide 50. Thus, each time the second face 46 completes a cycle, one shelf 30 rotates and drops its contents through the bottom of the frame member 22 and into the receptacle 70 (shown in FIG. 1).

Figure 7:
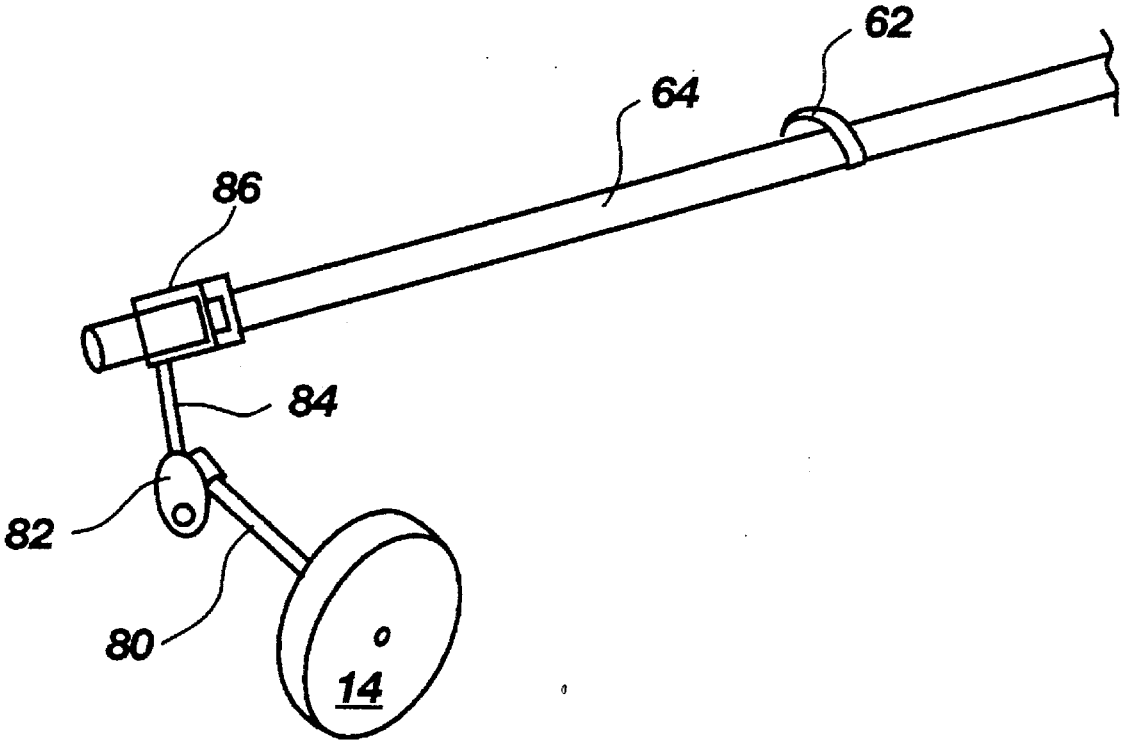
FIG. 7 is a perspective view of the cam shaft in communication with the coin latch knob.

As was mentioned previously, the second face 46 is moved up and down by rotation of the cam 62. The cam 62 (shown in FIGS. 1, 2 and 7) is disposed below the ratchet column 40. Referring specifically to FIGS. 1 and 7, the cam 62 is disposed about a cam shaft 64 such that rotation of the cam shaft 64 causes the cam 62 to rotate and move the second face 46 between the first and second positions. Each rotation of the cam shaft 64, therefore, causes the ratchet slide 50 to advance one groove.

The cam shaft 64 is preferably disposed below the frame member 22 (as shown in FIG. 1). When the vending apparatus has more than one vertical row of shelves 30 and more than one ratchet column, a cam 62 can be placed below each ratchet column 40. However, the preferred embodiment has a movable cam 62 (as shown in FIG. 1). The cam 62 is attached to a selector lever 66 and is slidable along the cam shaft 64. The selector lever 66 can be slid along a guide track 68 until it is under the ratchet column 40 for the desired product. Thus, with each turn of the cam shaft 64, only one ratchet column 40 can be moved, and only one shelf 30 rotated.

The rotation of the cam shaft 62 can be accomplished by several means. In its simplest form, the cam shaft 62 can be connected directly to the knob 14. Once coins are placed in the coin slots 12, the knob 14 is turned, rotating the cam shaft 62 and causing the desired product to be dispensed. Numerous other methods can be used so that rotation of knob 14 causes rotation of the cam shaft 62. For example, FIG. 7 shows a shaft 80 attached to the knob 14. When the knob 14 is turned, the shaft 80 rotates. The rotational force of the shaft 80 is transferred through a crank 82. The crank 82 is attached to a connecting rod 84 which transfers the force to a cam shaft lever 86. The cam shaft lever 86 causes the cam shaft 62 to rotate. Such a configuration allows placement of the knob 14 at a 90 degree angle to the cam shaft 64 or in virtually any other convenient location.

Disposed below the cam shaft in the preferred embodiment is a receptacle 70 (shown in FIG. 1). The receptacle is positioned such that product falling from the shelves 30 lands in the receptacle 70. This can be done by placing the receptacle directly beneath the frame member 20, or by having a chute (not shown) positioned beneath the frame member 20 to steer falling merchandise into the receptacle 70. The receptacle 70 can be most any design known in the art. The type of receptacle 70 will depend on the products dispensed and on other factors routinely considered in vending machine design.

In the manner described above, a simple and dependable vending apparatus is provided. It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications.

What is claimed is:

1. A vending machine dispensing apparatus comprising:

a frame member comprising a generally rectangular frame with two lateral sides and a front side, a plurality of shelves disposed within said frame member and pivotally attached to said frame member so as to pivot between a first, generally horizontal position, and a second, generally vertical position, holding means for retaining the plurality of shelves in the first, generally horizontal position, and releasing means for disengaging the holding means to thereby enable the shelves to rotate from the first, generally horizontal to the second, generally vertical position, the releasing means comprising at least one ratchet slide and at least one ratchet column having a first face held in a fixed position adjacent the plurality of shelves and a second face disposed opposite the first face so as to vertically slide relative to the first face between first and second positions, such that repeated movement of the second face between first and second positions causes the ratchet slide to move vertically along the column.

2. The vending machine dispensing apparatus of claim 1 wherein the frame member comprises a front side defining a plurality of holes arranged in vertical rows, each hole having an upper portion and a lower portion, the upper portion being larger than the lower portion.

3. The vending machine dispensing apparatus of claim 2 wherein the holding means comprises a tang member extending from each shelf so as to be disposed on a side of the pivotal attachment opposite the shelf, the tang member having a notched first end opposite the shelf so that when the shelf is in the first, generally horizontal position, the notched first end of the tang is in sufficient frictional contact with the lower portion of a hole to maintain the shelf in the first, generally horizontal position.

4. The vending machine dispensing apparatus of claim 3 wherein the release means is attached to the frame member adjacent at least one tang.

5. The vending machine dispensing apparatus of claim 4 wherein the ratchet slide is disposed on the ratchet column and positioned so as to contact the first end of a tang when ratcheted in an upward direction.

6. The vending machine dispensing apparatus of claim 5 wherein the release means further comprises a means for raising the ratchet slide up the ratchet column so that the ratchet slide comes into forceful contact with the first end of the tang of each shelf in one of said rows as the ratchet slide rises.

7. The vending machine dispensing apparatus of claim 6 wherein the raising means comprises a cam disposed below the ratchet column and positioned so as to move the ratchet column up and down as the cam rotates.

8. The vending machine dispensing apparatus of claim 1 further comprising a receptacle for receiving items falling from the shelves, the receptacle being disposed below the frame member in such a position as to allow access to contents of the receptacle by a person using the apparatus.

9. A vending machine dispensing apparatus comprising:

a housing member having a top panel, a bottom panel, and side panels disposed at lateral sides of the top and bottom panels to define a generally enclosed area, a frame member disposed within the housing member, the frame member comprising a generally rectangular frame with two lateral sides and a front side, the front side defining a plurality of holes comprising a first hole and arranged in vertical rows, each hole having an upper portion and a lower portion, the upper portion being larger than the lower portion, a plurality of shelves disposed within said frame member and pivotally attached to said frame member so as to pivot between a first, generally horizontal position, and a second, generally vertical position, a tang member extending from each shelf so as to be disposed on a side of the pivotal attachment opposite the shelf, each tang member having a notched first end opposite the shelf so that when the respective shelf is in the first, generally horizontal position, the notched first end of the tang is in sufficient frictional contact with the lower portion of a hole to maintain the shelf in the first, generally horizontal position, a ratchet column attached to the frame member, the column being disposed vertically, adjacent to a row of holes, a ratchet slide disposed on the ratchet column and positioned so as to contact the first end of a tang when ratcheted in an upward direction, and means for raising the ratchet slide up the column, said means comprising a first face comprising transverse grooves disposed on the column and a second face comprising transverse grooves disposed on a side of the ratchet column opposite the first face, the first face being fixedly attached to the frame member and the second face being movable vertically between a first position and a second position, wherein repeated movement of the second face between a first and second position causes the ratchet slide to move vertically up the column, and means for lifting the second face between the first and second positions.

10. The vending machine dispensing apparatus of claim 9 further comprising a receptacle for receiving items falling from the shelves, the receptacle being disposed below the shelves and adjacent to a side of the machine and in such a position as to allow access to contents of the receptacle by a person using the machine.

11. The vending machine dispensing apparatus of claim 9 wherein each groove of the second face is in horizontal alignment with a coinciding groove on the first face when the second face is in its first position, and wherein the grooves on the second face have been raised to a position one groove above the coinciding groove on the first face when the second face is in its second position.

12. The vending machine dispensing apparatus of claim 11 wherein the grooves on the first and second faces comprise a generally horizontal lower slope and a semi-vertical upper slope, and, wherein the rachet slide comprises a resilient material forming ridged flanges which are in complementary engagement with the lower slope of the transverse grooves of the first and second face, so that as the second face is raised to the second position, the lower slope of a groove on the second face lifts the corresponding ridge on the ratchet slide, causing the ridge corresponding to the first face to slide over the upper slope of the coinciding first face groove and into engagement with the lower slope of a groove positioned above the formerly corresponding groove, and as the second face returns to the first position, the lower slope of the now corresponding groove on the first face causes the ridge corresponding to the second face to slide over the upper slope of the groove on the second face, preventing the slide from returning to its original position.

13. The vending machine dispensing apparatus of claim 9 wherein the means for lifting the second face comprises a cam positioned beneath the second face so as to lift the second face when the cam is rotated, and further comprising a means for rotating the cam.

14. The vending machine dispensing apparatus of claim 13 wherein the means for rotating the cam comprises a cam shaft disposed within the housing and lying in a generally horizontal plane so that rotation of the cam shaft causes a vertical change in the height of the cam.

15. The vending machine dispensing apparatus of claim 14 further comprising a cam shaft lever for moving the cam horizontally along the cam shaft and into position beneath one of several ratchet columns.

16. The vending machine dispensing apparatus of claim 15 further comprising a knob operated coin latch means disposed on a side of the housing, said latch means being in communication with said cam shaft such that rotation of the knob operated coin latch means causes rotation of the cam shaft.

17. The vending machine dispensing apparatus of claim 16 further comprising a coin latch shaft attached at a central axis of the knob, a crank attached to the coin latch shaft such that rotation of the shaft causes rotation of the crank, a connecting rod in communication with the crank such that rotation of the crank causes upward movement of the connecting rod, and a cam shaft lever communicating with the connecting rod and the cam shaft such that upward movement of the connecting rod causes rotation of the cam shaft.

* * * * *